United States Patent [19]

Files et al.

[11] 4,290,651

[45] Sep. 22, 1981

[54] SURFACE MINING METHOD

[75] Inventors: Thomas I. Files, Marion, Ohio; Donald H. Beutner, Newburgh, Ind.

[73] Assignee: Dresser Industries, Inc., Dallas, Tex.

[21] Appl. No.: 26,638

[22] Filed: Apr. 3, 1979

[51] Int. Cl.[3] ..... E21C 41/00

[52] U.S. Cl. ..... 299/7; 299/18; 299/19

[58] Field of Search ..... 37/195; 299/19, 18, 299/7

[56] References Cited

U.S. PATENT DOCUMENTS

| | | | |
|---|---|---|---|
| 591,047 | 10/1897 | Mason | 37/195 |
| 779,043 | 1/1905 | Hulett | 37/195 |
| 1,872,076 | 8/1932 | Sherwood et al. | 37/195 |
| 4,133,581 | 1/1979 | Satterwhite | 299/7 |
| 4,150,853 | 4/1979 | McCoy | 299/19 |

FOREIGN PATENT DOCUMENTS

| | | | |
|---|---|---|---|
| 1221590 | 7/1966 | Fed. Rep. of Germany | 299/18 |
| 162081 | 4/1964 | U.S.S.R. | 299/18 |

OTHER PUBLICATIONS

"Komplette Tagebauausrustungen—Takraf—Veb Tranportanlagenprojekt Leipzig" Catalog of E. German Open Pit Machinerry. pp. 73–80.

*Primary Examiner*—William F. Pate, III

*Attorney, Agent, or Firm*—John M. Lorenzen

[57] ABSTRACT

The invention concerns a method of surface mining along an elongated pit using a cross-pit conveyor for transferring selected excavated material, such as topsoil, directly across the pit while using a separate overburden excavator to transfer the remaining overburden. The method uses a cross-pit transporter which is supported solely on the working bank, includes a cantilevered conveyor which extends completely across the pit, and is slewable so it can periodically swing to a non-interfering position when passing the other excavator. The method allows the selective replacement of the different overburden materials in accordance with modern reclamation practice.

5 Claims, 1 Drawing Figure

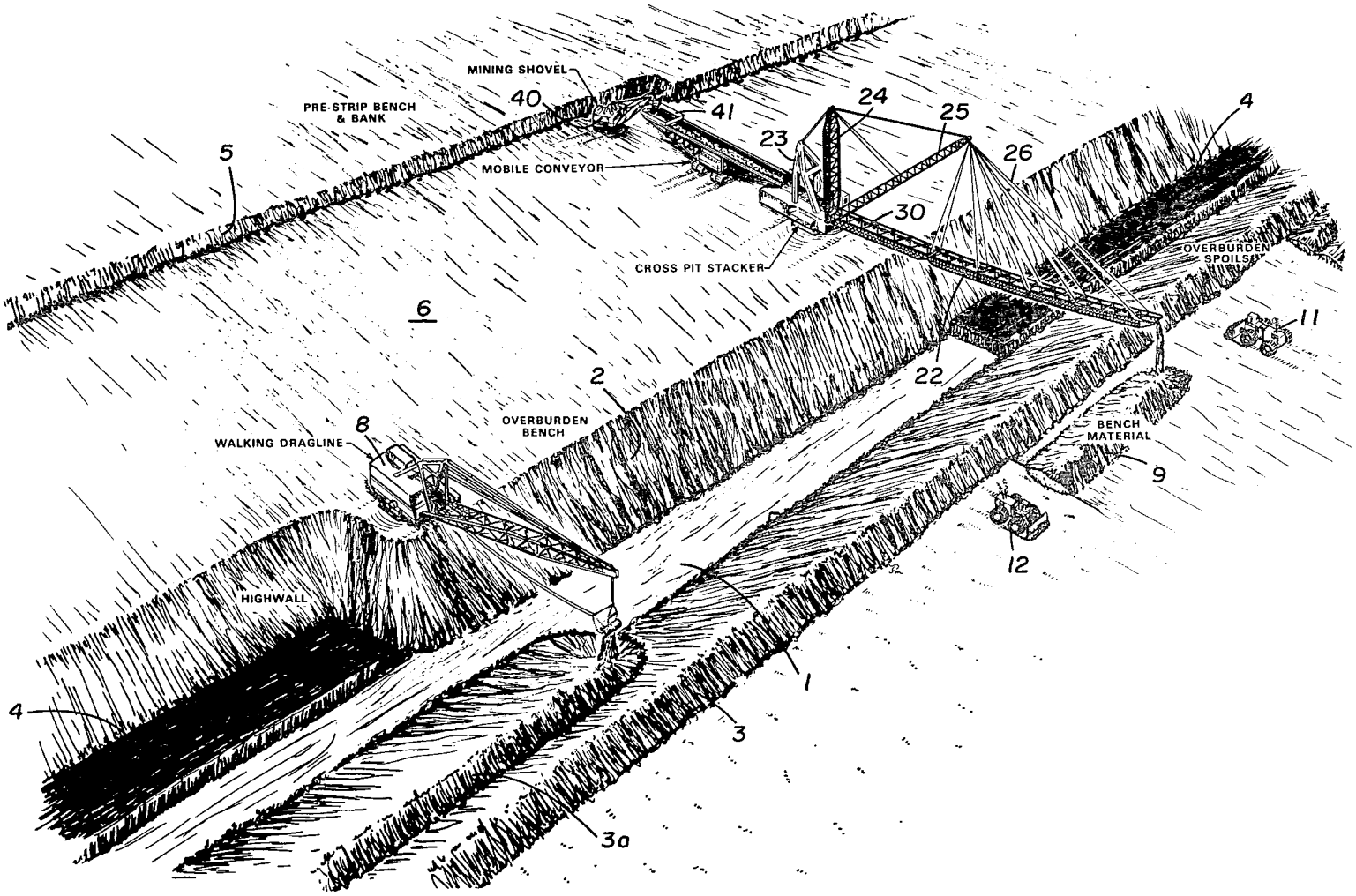
6

SURFACE MINING METHOD

The invention relates to surface mining, and more specifically to an improved method and apparatus for strip mining.

In a typical strip mining operation a relatively long, narrow pit is formed by removing the overburden from above a strip of the mineral seam. The mineral material is mined and removed progressively along the seam. Simultaneously a parallel strip of overburden is excavated along one edge of the initial pit and deposited in a spoils pile in the mined out area of the first pit. In this way a new pit, parallel to the first, is formed and as it is mined still another pit is developed by removing a strip of overburden and depositing it in the preceding pit. This process is repeated over and over, usually with the equipment operating in a back-and-forth manner along pits several miles long.

Reclamation of the mined out area includes the redistribution of the overburden; usually by using bulldozers or the like to level out the peaks and valleys of the spoils piles. Increasing concern over land reclamation recognizes that the overburden consists of discernible layers of different compositions. In particular it normally consists of an upper layer of top soil over one or more layers of rock or the like. Modern reclamation practices therefore require a segregation and separate handling of the richer top soil layer so that it can be appropriately replaced atop the remaining overburden materials.

After the top soil is removed, the remaining overburden is often excavated and deposited directly across and along the far side of the preceding pit using a dragline, stripping shovel, or other well-known equipment. On the other hand the excavated top soil has to be transported a long distance around the end of the pit to be deposited beyond the previous spoils pile. Typically this function is performed either by haulage vehicles or by long shiftable conveyor systems. In either case, due to the length of the pits, the transportation of the top soil represents a major operating expense for the mine owner.

Previous attempts to reduce such costs by transferring the top soil or other selected layer of material more directly across the pit have not been satisfactory. Some such systems involve the use of equipment located or supported in the pit itself. In such systems this equipment interferes with the actual mining, hauling, and other operations performed in the pit. The use of long bridge conveyors spanning the pit has also been tried. Such equipment has necessarily been supported on both banks of the pit. Since access roads to the pit are typically from the far bank, such bridge conveyor equipment has difficulty advancing along the pit without special arrangements when encountering such roadways. Furthermore the supports on the far bank side interfere with the leveling of the spoils piles.

It is the object of the present invention to provide a method of strip mining in which the top soil, or other selected layer of earth, is separately excavated and transported directly over and across the pit and selectively deposited beyond the previous spoils piles without interfering with the mining or reclamation operations.

It is another object of the invention to provide an apparatus useable in a strip mining operation for conveying material directly across the pit, which is self-propelled and supported solely on the near bank above the pit and which can be pivoted to enable it to pass by other equipment operating on the same bank or in the pit.

Our novel apparatus includes a self-propelling or ambulatory base on which an upper frame is rotatably mounted. A boom, long enough to reach across a strip mining pit and as far beyond as desired is cantileveredly supported from the upper frame. Conveying means, such as an endless belt conveyor, extends from the frame along the boom and is adapted to receive excavated material at the frame end and transfer it across the boom for discharge at the free end of the boom. The upper frame and boom can be pivoted back and forth to windrow the material as it is discharged, or when necessary swung sufficiently to allow passage of a dragline or other equipment operating along the same bank of the pit.

This apparatus facilitates an improved method of strip mining in which the top soil, or other selected layer, can be removed in a strip ahead of the normal overburden removal, and transferred directly across the pit for selected deposit beyond the appropriate spoils pile without interfering with the other mining and reclamation operations. The result is a substantial reduction in mine operating costs. The following more detailed description of the improved mining method and apparatus embodying the invention refers to the accompanying drawing. The drawing is a three-dimensional illustration of a typical strip mining operation and shows an apparatus embodying the invention along with other associated equipment.

The drawing shows a strip mining operation which has already progressed beyond the first pit formed by a box cut. The current pit 1 refers to the long and relatively narrow channel between the high wall 2 of the near bank and the spoils pile 3 on the far bank. The spoils pile 3 was formed by the overburden that was removed from the current pit 1 and deposited in the mined out area of a previous pit. The exposed, but as yet unmined strip of the mineral seam 4, forms the floor of the pit. While the dimension may vary widely, the pit will be typically 90–120 feet wide at the bottom and from several thousand feet to a few miles long.

A somewhat wider strip of the upper layer of earth 5, hereinafter referred to as the topsoil layer, has been removed to leave the overburden bench 6. For purposes of example only the topsoil layer 5 may be in the range of 10–20 feet high while the remaining overburden may be 100 feet deep.

The mineral material 4 can be removed from the pit by using a mining shovel and truck or by other well-known types of mining equipment. However it is typical to work the equipment progressively from one end of the pit to the other. Simultaneously the overburden along the high wall or near bank side is being excavated and deposited along the far bank side in the pit progressively in the area where the mineral material has already been removed. Again while several types of equipment can be used for the stripping operation, a self-propelling dragline 8 is shown. The dragline is located and operated on the overburden bench 6.

So far the strip mining operation described has been conventional. However, the operation shown in the drawing includes a cross pit conveyor/stacker apparatus 10 which has not been used heretofore. This apparatus is being used to transfer the excavated material from the topsoil layer 5 directly across the pit 1 and deposit it in a segregated spoils pile 9 beyond the previous spoils pile 3 from the dragline operation. Such placement facilitates the ensuing reclamation operations. For instance, a dozer, or front end loader, indicated at 11 is used to level out the peaks and valleys of the overburden spoils piles, and then another dozer, or front end loader, indicated at 12 spreads the top soil material over the top of the previous overburden to leave the area suitable for re-use.

The conveyor/stacker apparatus 10 sits upon and operates from the bench 6 on the near side of the pit. It has a self-propelling base 20 upon which the upper structure 21 is rotatably mounted. The base may be mounted on crawlers, or a tub with a walking device. The latter may be preferable where low ground pressure is a factor. The upper structure or frame 21 supports a cantilevered boom 22. The boom length is determined to reach at least across the pit 1 and as far beyond as necessary to deposit the topsoil where desired. In order to support the long boom, the frame 21 includes structural members, such as gantry 23, mast 24, stiffleg 25, and appropriate rigging 26. In some cases, it may also be necessary to provide a counterweight at the rear of the frame 21.

A conveying means 30, such as a continuous belt conveyor, is supported by and extends along the boom 22. In the embodiment shown the conveyor 30 extends all the way from the rear of the frame 21 to the free end of the boom. The conveyor is adapted to receive the excavated topsoil or bench material, convey it across the pit and discharge it off the end of the boom in an area and manner selected by the operator.

The apparatus 10 is unique in several respects. First, as opposed to a dragline for instance, it allows a continuous flow of material. Second, since it is solely supported on the bank, it does not interfere with mining equipment or stripping shovels, which operate in the pit itself. Thirdly, since no part of the apparatus is supported on the far bank, it does not interfere with the construction and use of access roads or the reclamation operations along that bank. Fourthly since the frame and boom are rotatably mounted on the base, the boom can be swung back and fourth through a small arc to windrow the discharging materials and thus assist the reclamation process. Further the upper frame and boom can be pivoted a fully 360°, therefore the boom can be swung out of the way to enable the apparatus to pass by dragline working along the same bank, a stripping shovel sticking up above the pit, or the like.

In the drawing the topsoil layer is being excavated by a mining shovel 40, deposited in a hopper 41 on a mobile conveyor 42, and in turn discharged onto the cross pit conveyor 30. Various alternatives are possible in this phase of the operation. Other well-known excavators, such as front end loaders and bucket wheel excavators, can be used to dig the top soil layer and deliver it to the cross pit conveyor/stacker apparatus 10. It is also conceivable that a swingable or extendable tail conveyor can be part of the apparatus itself.

Various other modifications or additions to the structure 10 may be made to expand its capability in respect of other functions as well. For instance the boom may be constructed of articulately connected sections. Such as articulated boom can be raised to provide greater clearance for passing other mining equipment, or to permit higher stacking of the conveyed material. On the other hand it may be desirable to elevate intermediate sections to clear spoils piles or other items, and at the same time tilt the end sections down to lower the dumping height. Raising and lowering of the boom sections can be accomplished with live reeving.

Also various control equipment can be added to improve the functions of the apparatus. For example, the speed of the conveyor or the rate of swing of the boom can be regulated in respect to each other or in correlation to the amount of material being carried on the conveyor. This will enable regulation of the windrow being formed by the discharge and thereby further assist the reclamation activities.

Other variations of the cross pit conveyor as described herein will occur readily to those familiar with strip mining operations and equipment and are within the scope of the invention described herein and in the claims which follow.

The principal advantage of using the apparatus 10 in a strip mining method as shown is in the elimination of the need to transport the top soil or other selected material a long way around the pit and in being able to do so without interfering with any of the other operations. While it has been described in transferring the segregated topsoil layer across the pit to the reclamation area, it should be apparent that the principal and apparatus may have other applications wherein it is desirable to separately transfer an upper layer across the pit from on top the next lower layer which is itself elevated above the pit.

The embodiments of the invention in which an exclusive property or privilege is claimed are defined as follows:

1. A method of surface mining along an elongated pit exposing a strip of the mineral seam between two opposed banks, using a cross-pit transporter having a conveying means extending completely across the pit and an overburden excavator moveable along the working bank of the pit within the normal working path of the cross-pit transporter comprising the steps of:

a. progressively excavating the topsoil layer along the working bank of the pit;

b. separately and progressively excavating the remaining overburden along said working bank using the overburden excavator and transferring the excavated overburden material and depositing it in spoils piles along the opposite bank of the pit;

c. separately transporting the topsoil directly across and over the pit using the cross-pit transporter and depositing such topsoil selectively with respect to said overburden material on the opposite bank while pivotably supporting said conveying means solely from one bank, whereby said cross-pit conveying means is occasionally pivoted to a non-interfering position to permit passing of said overburden excavator to change the relative positions of the two machines.

2. A method of surface mining as recited in claim 1 further including swinging the cross-pit conveyor about its sole support to a position generally perpendicular to its normal working position to permit passing of said overburden excavator.

3. A method of surface mining along an elongated pit which exposes a strip of the mineral seam between a working bank and a spoils bank, using a cross-pit material transporter pivotably supported solely on the working bank and having a conveying means extending completely across the pit and an overburden excavator movable along said working bank of the pit, comprising the steps of:

a. progressively excavating an upper layer of overburden along the working bank, and transporting the material from said upper layer directly across and over the pit and depositing it on the spoils bank using the material transporter;

b. concurrently, separately and progressively excavating the remaining overburden along said working bank using the overburden excavator and transferring the excavated remaining overburden to the spoils bank;

c. continuing steps (a) and (b) moving in one direction along the pit;

d. upon reaching the end of the pit, pivoting the cross-pit transporter to a non-interfering position to permit passing of said overburden excavator to change the relative working positions of the two machines; and e. repeating steps (a) and (b) moving in the opposite direction along the pit.

4. A method of surface mining as recited in claim 3 wherein step (a) comprises excavating topsoil material, and transporting and selectively depositing said topsoil material using the material transporter.

5. A method of surface mining as recited in claim 3, wherein step (d) comprises swinging the cross-pit transporter generally horizontally to a position substantially perpendicular to its normal operating position while passing said overburden excavator.

* * * * *